United States Patent [19]

Clafford

[11] 4,254,713

[45] Mar. 10, 1981

[54] DAMPING RAILWAY TRUCK FRICTION SHOE

[75] Inventor: Arthur H. Clafford, Chicago, Ill.

[73] Assignee: AMSTED Industries Incorporated, Chicago, Ill.

[21] Appl. No.: 96,462

[22] Filed: Nov. 21, 1979

[51] Int. Cl.[3] ..... B61F 5/06; B61F 5/12; B61F 5/24

[52] U.S. Cl. ..... 105/197 DB; 267/9 A

[58] Field of Search ..... 105/197 D, 197 DB; 267/9 A

[56] References Cited

U.S. PATENT DOCUMENTS

| | | | |
|---|---|---|---|
| 2,953,995 | 9/1960 | Baker | 105/197 DB |
| 4,109,585 | 8/1978 | Brose | 267/9 A |

*Primary Examiner*—Howard Beltran

*Attorney, Agent, or Firm*—Edward J. Brosius; Fred P. Kostka; John L. Schmitt

[57] ABSTRACT

A friction shoe is provided for use in a railway truck. The shoe is placed such that it frictionally engages both a side frame vertical column and the slope surface of the bolster to dampen the oscillating motion of the bolster in the side frame. The shoe is provided with winged extensions and tapered flanges that engage a complementary slope surface and raised flange on the bolster.

1 Claim, 4 Drawing Figures

DAMPING RAILWAY TRUCK FRICTION SHOE

BACKGROUND AND SUMMARY OF THE INVENTION

The present invention relates to an arrangement to dampen the oscillating motion of a bolster in a railway truck side frame. More particularly, the invention relates to a winged friction shoe and complementary bolster wherein a winged surface and an additional flanged surface on the friction shoe engage a complementary sloped surface and a raised flange on the bolster.

The present arrangement is an improvement over the friction shoe arrangements shown in U.S. Pat. Nos. 2,953,995 and 4,109,585, both of which are assigned to the assignee of the present invention.

The type of railway car truck to which the present invention relates comprises two spaced side frame members each having an opening arranged to resiliently support opposite ends of a bolster. A spring biased friction shoe is provided which includes a substantially vertical wall engageable with a friction surface on the side frame. The friction shoe also includes flanges or wings together with two additional flanged surfaces which project laterally from a body portion of the shoe. These wings and additional flanges bear against a complementary sloped surface and a raised flange on the bolster.

The provision of additional bearing surfaces by the additional flange of the friction shoe contacting the side of the raised flange of the bolster acts to spread the friction forces over a greater contact area between the friction shoe and the bolster. Accordingly, the service life of the friction shoe and the truck bolster are extended.

Further, the additional flanges will tend to center the friction shoe in the side frame opening, thereby reducing the undesirable contact at the sides and, accordingly, increase the stability of the friction shoe.

It is an object of the present invention to provide an arrangement for dampening the oscillating motion of a bolster in a railway truck side frame.

It is a further object of the present invention to provide an arrangement for dampening the oscillating motion of a bolster in a railway truck side frame by the use of a friction shoe which contacts the bolster and the side frame and wherein an extended service life of the friction shoe and the contacting surfaces of the side frame and bolster are provided.

BRIEF DESCRIPTION OF THE DRAWINGS In the drawings.

DESCRIPTION OF THE PREFERRED EMBODIMENT

Figure 1:
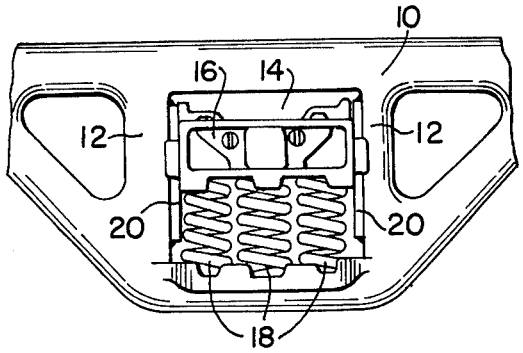
FIG. 1 is a fragmentary side elevational view of a railway car truck embodying the present invention.

In FIG. 1 there is shown a side frame 10 having a pair of columns 12 defining the sides of a bolster opening 14 formed in the frame. One end of a bolster 16 is resiliently supported in the bolster opening 14 and springs 18. Friction plates 20 may be integral with or suitably mounted on side frame columns 12.

Figure 2:
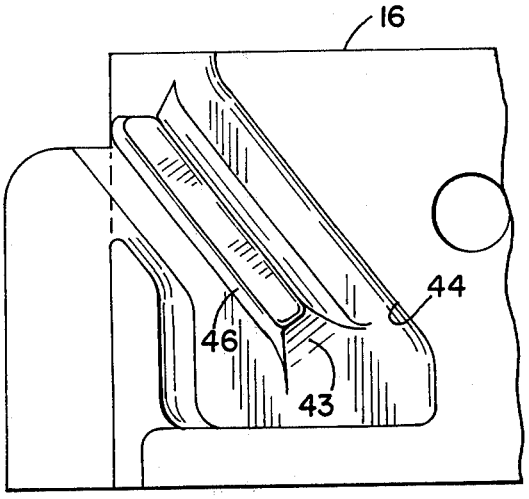
FIG. 2 is a partial side elevational view of the bolster embodying the present invention.

As shown in FIG. 2, bolster 16 includes a sloped edge guiding surface 44, and a separate raised flange 43. Raised flange 43 has a guiding surface 46. Raised flange 43 will usually be integrally cast as a part of bolster 16.

Figure 4:
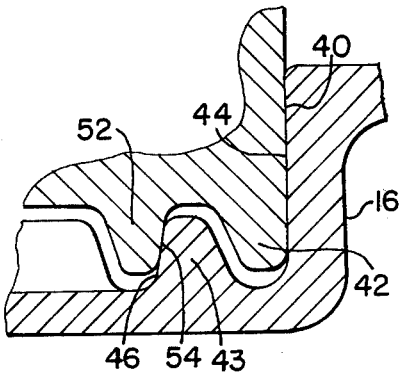
FIG. 4 is a partial sectional view of the friction shoe and bolster showing the engagement of the friction surfaces.
Figure 3:
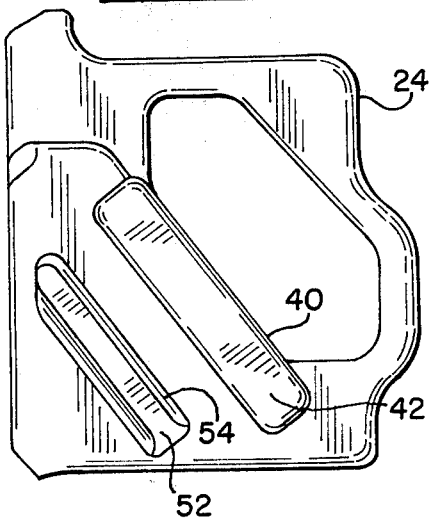
FIG. 3 is a side elevational view of the friction shoe embodying the present invention.

As shown in FIG. 3, friction shoe 24 includes a vertical friction wall 28 which frictionally engages a friction surface on the side frame column friction plate 20. Friction shoe 24 is urged into frictional engagement with plate 20 by a spring (not shown) which is compressed between a lower wall (not shown) of bolster 16 and an upper wall (not shown) of friction shoe 24. As shown in FIGS. 2, 3 and 4, the spring urges an upper surface 40 of sloped wings 42, which project outwardly from opposite sides of friction shoe 24, into engagement with edge guiding surface 44 of bolster 16. Further, friction shoe 24 includes additional sloped flanges 52 which project laterally from opposite sides of the friction shoe. The upper surface 54 of flanges 52 are also urged by the spring into engagement with surface 46 of raised flange 43 on bolster 16. Thus two frictional contacting interfaces are provided between friction shoe 24 and bolster 16.

Although a preferred embodiment of the present invention has been set forth above, the scope of the present invention is set forth in the following claims.

What is claimed is:

1. A friction apparatus for a railway car truck comprising a side frame having a substantially upright column partially defining a bolster opening, a bolster resiliently supported in said opening for vertical movement therein, a vertical planar friction surface on said column, guiding surfaces on said bolster comprising sloped edge guides and separate parallel sloped raised flanges providing separate guiding surfaces, a friction shoe comprising a substantially vertical wall, two sloped wings projecting laterally outward from said shoe forming an acute angle with said vertical wall and two separate parallel sloped flanges also projecting laterally outward from said shoe from a location downward and toward said vertical wall from said wings, each of said flanges comprising a separate raised portion of said friction shoe, said raised portion extending to a position adjacent to the vertical wall of said friction shoe, a spring urging said wings into engagement with said edge guides and said sloped flanges into engagement with both said separate guiding surfaces thereby guiding said vertical wall into contact with said planar friction surface.

* * * * *